US006815673B2

(12) United States Patent
Plomley et al.

(10) Patent No.: US 6,815,673 B2
(45) Date of Patent: Nov. 9, 2004

(54) USE OF NOTCHED BROADBAND WAVEFORMS IN A LINEAR ION TRAP

(75) Inventors: Jeffry B. Plomley, Aurora (CA); Frank A. Londry, Peterborough (CA)

(73) Assignee: MDS Inc., Concord (CA)

( * ) Notice: Subject to any disclaimer, the term of this patent is extended or adjusted under 35 U.S.C. 154(b) by 94 days.

(21) Appl. No.: 10/322,464

(22) Filed: Dec. 19, 2002

(65) Prior Publication Data

US 2003/0122071 A1 Jul. 3, 2003

Related U.S. Application Data

(60) Provisional application No. 60/341,751, filed on Dec. 21, 2001.

(51) Int. Cl.[7] ..... H01J 49/42; H01J 49/40

(52) U.S. Cl. ..... 250/292; 250/287; 250/282; 250/281; 250/290; 250/293; 250/299

(58) Field of Search ..... 250/281–299

(56) References Cited

U.S. PATENT DOCUMENTS

| | | | | |
|---|---|---|---|---|
| 5,179,278 A | | 1/1993 | Douglas | |
| 5,449,905 A | | 9/1995 | Hoekman et al. | |
| 5,689,111 A | | 11/1997 | Dresch et al. | |
| 5,959,297 A | * | 9/1999 | Weinberg et al. | 250/288 |
| 6,011,259 A | | 1/2000 | Whitehouse et al. | |
| 6,020,586 A | | 2/2000 | Dresch et al. | |
| 6,075,244 A | * | 6/2000 | Baba et al. | 250/292 |
| 6,093,929 A | | 7/2000 | Javahery et al. | |
| 6,285,027 B1 | * | 9/2001 | Chernushevich et al. | 250/287 |
| 6,326,615 B1 | | 12/2001 | Syage et al. | |
| 6,483,109 B1 | * | 11/2002 | Reinhold et al. | 250/292 |
| 6,507,019 B2 | * | 1/2003 | Chernushevich et al. | 250/287 |
| 6,534,764 B1 | * | 3/2003 | Verentchikov et al. | 250/287 |
| 2002/0024010 A1 | * | 2/2002 | Hager | 250/282 |
| 2002/0030159 A1 | * | 3/2002 | Chernushevich et al. | 250/287 |
| 2002/0121594 A1 | * | 9/2002 | Wang et al. | 250/281 |
| 2002/0175278 A1 | * | 11/2002 | Whitehouse | 250/281 |
| 2003/0122071 A1 | * | 7/2003 | Plomley et al. | 250/292 |
| 2003/0189168 A1 | * | 10/2003 | Londry et al. | 250/282 |
| 2003/0189171 A1 | * | 10/2003 | Londry et al. | 250/292 |

FOREIGN PATENT DOCUMENTS

| | | |
|---|---|---|
| WO | WO 93 12536 | 6/1993 |
| WO | WO 99 62101 | 12/1999 |
| WO | WO 00 33350 | 6/2000 |

* cited by examiner

*Primary Examiner*—John R. Lee
*Assistant Examiner*—Bernard Souw
(74) *Attorney, Agent, or Firm*—Bereskin & Parr; Isis E. Caulder

(57) ABSTRACT

A method and apparatus for the analysis of a narrow range of fragment ions by application of a notched broadband waveform during ion accumulation within a quadrupole collision cell operated as a linear ion trap. The fragment ions are formed via the axial acceleration and collision activated dissociation of mass resolved precursor ions. A narrow band of frequencies is purposefully omitted from the spectrum, so that the secular frequency of a particular fragment ion will fall within this notch of absent frequencies and as a result will not experience resonant excitation and are retained in the linear ion trap. Simultaneously, all other ions are lost either through neutralization when they strike electrodes or through (additional) collision activated dissociation. Accordingly, a particular mass or range of masses, whose secular frequencies fall within the notch of absent frequencies in the notched broadband waveform, may be selectively accumulated during the collision activated dissociation event.

14 Claims, 7 Drawing Sheets

USE OF NOTCHED BROADBAND WAVEFORMS IN A LINEAR ION TRAP

This application claims priority from U.S. provisional patent application No. 60/341,751 filed Dec. 21, 2001.

FIELD OF THE INVENTION

This invention relates to mass spectrometry, and more particularly is concerned with a method of analyzing ions using mass spectrometers where at least one of the quadrapoles is operated as a linear ion trap.

BACKGROUND OF THE INVENTION

The development of linear radio frequency (RF) multipole technology has led to significant improvements in sensitivity for those mass spectrometers which are coupled to continuous ionization sources (e.g. electrospray) but operate in a pulsed fashion, such as orthogonal time-of-flight (oTOF) devices, Paul ion traps, and Fourier Transform Ion Cyclotron Resonance (FTICR) traps. Multipoles located upstream of the mass analyzer may be operated as storage devices such that ions produced from the source are trapped while ions in the mass spectrometer are scanned. In this manner, instrument duty cycle, and therefore sensitivity, is improved. Sensitivity gains using multipole ion storage capabilities coupled to oTOF devices are detailed in U.S. Pat. No. 5,689,111 (Dresch et al.), U.S. Pat. Nos. 6,020,586 and 6,011,259 (Whitehouse et al.) as well as PCT WO 00/33350 (Douglas et al.) Multipoles coupled to Paul ion traps are documented by Douglas (U.S. Pat. No. 5,179,278), Cha et al. (Anal. Chem. 2000, 72, 5647–5654), and Whitehouse et al. (U.S. Pat. No. 6,121,607) while multipoles coupled to FTICR traps are reported by Senko et al. (J. Am. Soc. Mass Spectrom. 1997, 8, 970–976), and Belov et al U. Am. Soc. Mass Spectrom. 2001, 12, 38–48; Anal. Chem. 2001, 73, 253–261).

A further benefit of operating multipoles as ion storage devices is that ion trajectories may be manipulated through the application of auxiliary RF fields. Most techniques involving such ion-trajectory manipulation use an electrode configuration, which generates a quadrupole electric field because the characteristics of ion motion can be predicted most accurately in this environment. The characteristic motion of ions with stable trajectories in an RF quadrupole field allow them to be excited resonantly, in a mass-selective way, through the application of auxiliary RF fields. The consequences of resonant excitation, whether collision activated dissociation (CAD) or collisions with electrodes, can be controlled, to some degree, by adjusting the amplitude of the auxiliary RF signal. Consequently, those skilled in the art often use auxiliary RF fields for applications involving (i) precursor ion isolation via the resonance ejection of all unwanted ions, (ii) resonant excitation of the isolated precursor ion to promote the formation of specific fragment ions from the said precursor ion by collision activated dissociation. Finally, in those cases where such isolation and excitation occur in a device, which is capable of mass-selective detection, an auxiliary RF signal is applied to facilitate mass-selective ion ejection for the purposes of detection.

Two well-known mass spectrometer designs include the triple-stage quadrupole mass spectrometer and the quadrupole orthogonal time of flight mass spectrometer (Qq-oTOF), both of which consist of a plurality of quadrupoles, any one of which may be utilized as a linear ion trap (LIT). One of the earliest reports for using a quadrupole as a linear ion trap in a triple-stage quadrupole arrangement originated from G. G. Dolnikowski, M. J. Kristo, C. G. Enke, and J. T. Watson (Int. J. of Mass Spectom. and Ion Processes 82 (1988) 1–15) wherein product ions in the collision cell were stored by raising the potential of an inter-quadrupole aperture lens above the DC offset voltage of the quadrupole. J. Throck Watson, D. Jaouen, H. Mestdagh, and C. Rolando (Int. J. of Mass Spectrom. and Ion Processes 93 (1989) 225–235) described using a Nermag multi quadrupole mass spectrometer to study ion/molecule reactions, wherein ions were ejected in a mass-selective way from the collision cell by supplying auxiliary RF power at selected frequencies.

In contrast, Douglas in U.S. Pat. No. 5,179,278 teaches that a plurality of frequency components comprising a noise spectrum may be applied to a LIT to eject radially a broad range of masses such that ions may be accumulated in a mass-selective way by a Paul trap located down-stream. In PCT patent WO 00/33350, Douglas et al describe utilizing the collision cell in a triple-stage quadrupole as a LIT wherein axial acceleration of a mass resolved precursor ion into the trap causes fragmentation (MS/MS). Once fragment ions and unfragmented precursors are stored in the trap, a notched broadband waveform is applied to isolate an ion of interest for another stage of MS induced via radial excitation CAD. The LIT isolation/dissociation can occur over several cycles for MS capabilities. Ions are then passed to Q3 for mass analysis. PCT WO 00/33350 further discloses the ability to perform identical operations in a Qq-oTOF, with initial precursor ion selection performed in Q1 and mass analysis provided by the TOF.

Other examples of coupling LITs to oTOF mass analyzers are provided in U.S. Pat. No. 6,011,259 (Whitehouse et al) and U.S. Pat. No. 6,020,586 (Dresch et al). However, unlike the patent of Douglas et al (PCT WO 00/33350), there is no Q1 precursor ion selection. Notably, Q1 precursor ion selection with axial acceleration into a collision cell is preferred over radial excitation of a previously trapped precursor to create the first generation spectrum because more kinetic energy is available to fragment the precursor through axial acceleration. The ability to adjust the collision energy over a broad range allows the relative abundance of fragment ions to be controlled.

In the LIT configurations above, notched broadband waveforms or auxiliary RF are applied for the purpose of resonant ejection after ions are trapped, and not during the accumulation period. It is well known that ions in the fringing region have poorly defined trajectories and are easily lost. It is possible that this technique has not been used previously because it was thought that an auxiliary waveform, applied during the fill, would result in increased losses in the fringing region, but this is demonstrably not so. Accordingly, prior art linear ion trap configurations have been designed to apply notched broadband waveforms or auxiliary RF after ions have been accumulated by the ion trap.

There are several disadvantages associated with delaying until the fill is complete. Specifically, as charge accumulates, heavier ions can be lost preferentially. By accumulating the ion of interest, which may be a heavier ion, this undesirable loss of intensity is avoided. Similarly, a low intensity fragment cannot be accumulated preferentially unless the broadband is applied during the fill. In consequence, the space-charge limit could be reached before a sufficient number of the fragments of interest had accumulated. Also, duty cycle is degraded by waiting until after the fill to isolate the ion(s) of interest. Finally, in some cases, undesirable chemistry may occur among different fragments. By ejecting unwanted fragments as soon as they are formed, the probability of undesirable chemistry is reduced considerably.

SUMMARY OF THE INVENTION

The present invention provides a method of analyzing a substance in a mass spectrometer apparatus comprising an ion source, a quadrupole ion guide, and a linear ion trap, the method comprising the steps of:

(a) ionizing the substance to generate a stream of ions;

(b) supplying the stream of ions to the quadrupole ion guide to select ions within a broad range of mass-to-charge ratios;

(c) providing the stream of ions from the quadrupole ion guide to the linear ion trap for the generation and accumulation of fragment ions;

(d) simultaneously with step (c) applying a notched broadband waveform having a first notch width to the linear ion trap to select fragment ions within a predetermined mass range; and (e) analyzing the fragment ion spectrum after accumulation.

The present invention also provides an apparatus for analyzing a substance, the apparatus comprising:

(a) an ion source for generating a stream of ions;

(b) a quadrupole ion guide for receiving the stream of ions and for selecting ions within a broad range of mass-to-charge ratios;

(c) a linear ion trap to receive the selected ions from the quadrupole ion guide and to generate and accumulate fragment ions from the stream of ions;

(d) means for generating and applying a notched broadband waveform to the linear ion trap waveform during the accumulation of fragment ions, said means being coupled to said quadrupole ion guide for selection of a mass range of fragment ions; and (e) a mass analyzer connected to the quadrupole ion guide, for receiving fragment ions from the linear ion guide and for analyzing the ion spectrum.

DETAILED DESCRIPTION OF THE INVENTION

Figure 1A:
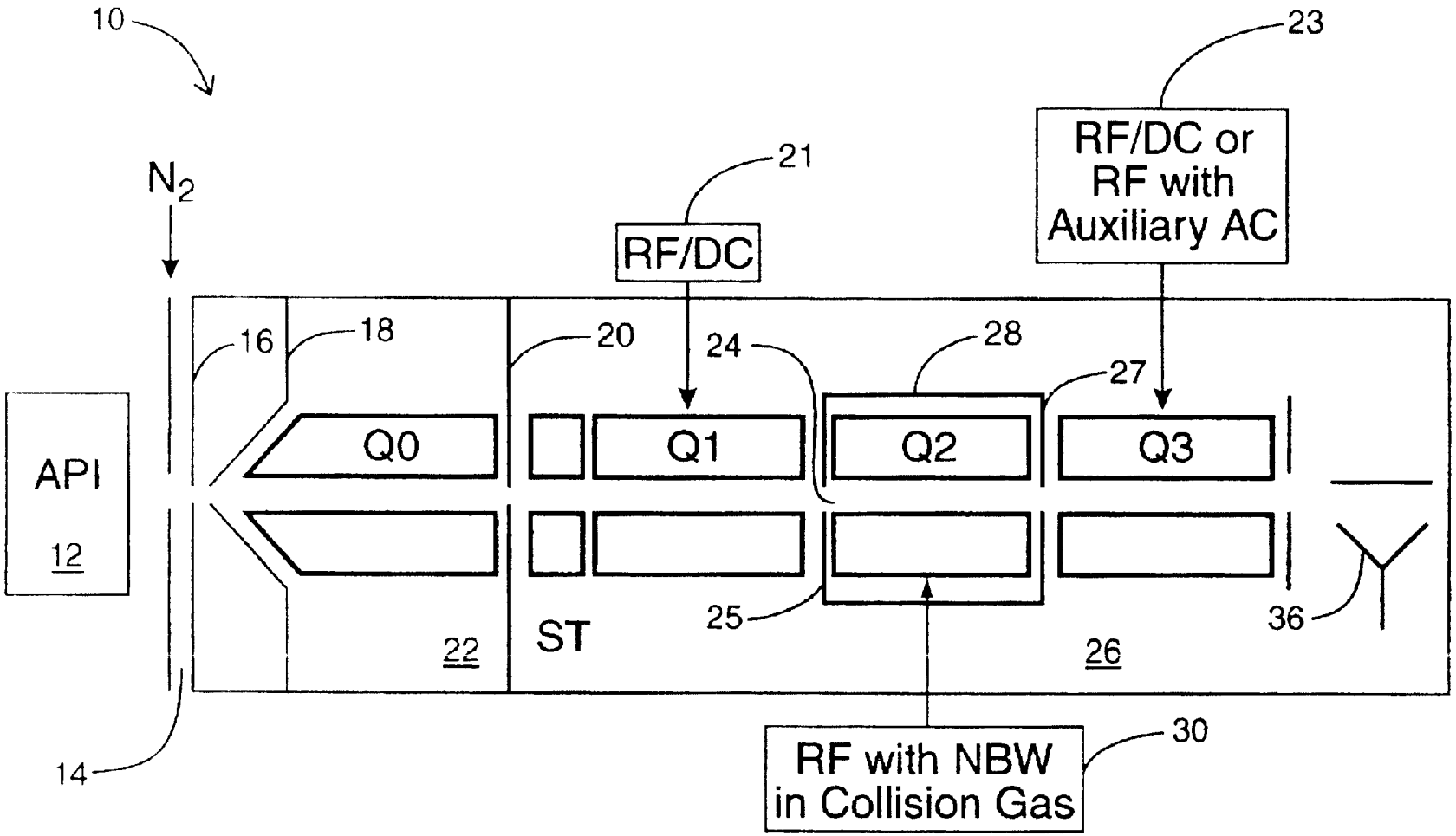
FIGS. 1A and 1B are schematic views of two mass spectrometer configurations, each containing a linear ion trap in which the present invention can be implemented.

FIG. 1A shows the general structure of a conventional triple-stage mass spectrometer 10 configured to implement the invention. Ions are generated by an atmospheric pressure interface (API) 12, and pass through a dry nitrogen "curtain gas", indicated at 14, which promotes vaporization of solvent. The ions then pass through an opening in orifice plate 16, and then through another opening in a skimmer plate 18, into a first quadrupole rod set Q0. A rotary pump (not shown) is coupled to the region in between orifice plate 16 and skimmer plate 18 to maintain a desired low pressure therein.

The rod set Q0 is located in a first chamber 22 which is connected to a turbo molecular pump (not shown) utilized to maintain a pressure of approximately $7\times10^{-3}$ torr in the first chamber 22. A rotary roughing pump is used to maintain the region between orifice plate 16 and skimmer plate 18 at a pressure of approximately 2 torr. In known manner, the rod set Q0 is provided with electrical connections for supply of RF and DC voltages so that it operates as an ion guide. The rod set Q0 is operated in the RF only mode, to transmit ions of a broad range of mass-to-charge (m/z) ratios. For simplicity, details of electrical connections, and electrical supplies are omitted.

Ions then pass through an entrance lens 20 from the first chamber 22 into a main chamber 26 of the mass spectrometer 10. Within the main chamber 26, there are located first, second and third quadrupole rod sets, indicated as Q1, Q2, and Q3. As is conventionally known, a (not shown) connection within the main chamber 26 to a suitable turbo molecular pump would be provided, so as to maintain a pressure of 2 to $3\times10^{-5}$ torr in the main chamber 26. A short set of rods or "stubbies" denoted by "ST" in FIG. 1A are provided to focus ions entering the main vacuum chamber of the mass spectrometer 10. Quadrupole rod set Q1 is supplied with suitable DC and RF voltages as shown at 21 to operate as a mass filter to select ions with a desired mass-to-charge (m/z) ratio. A detector 36 is provided at the exit from the final quadrupole rod set Q3.

The second quadrupole rod set Q2 is enclosed in a chamber 28 and provided with a connection for gas (not shown), so that a higher pressure can be maintained typically at around 2–10 millitorr. It should be understood however, that it is not necessary to operate chamber 28 at such high pressure and that pressures one or two orders of magnitude less could also be used as an apparatus within which the present invention can be implemented. The second quadrupole rod set Q2 is also provided with RF and DC voltages as shown at 23 in a known manner, so as to operate as a mass filter to select a precursor ion of a specific mass-to-charge (m/z) ratio. As is conventionally known, the chamber 28 with the rod set Q2 forms a collision cell. An entrance plate 25 and an exit plate 27 having apertures are provided at the ends of the housing 28, which may be either separate from the housing 28 or integral therewith. The plates 25 and 27 are conductive, insulated from each other and connected to voltage sources (not shown).

As is conventionally known, downstream from the collision cell 28 is a third quadrupole rod set Q3, configured as a mass analyzer. It is preferred for quadrupoles Q3 to be operated between 2 to $3\times10^{-5}$ torr (as noted above). For operation as a conventional triple quadrupole MS/MS system, the quadrupole rod sets Q0, Q1, Q2 and Q3 would be connected to conventional voltage sources, for supplying DC and RF voltages as required.

In use, ions generated from the atmospheric pressure interface 12 pass into the quadrupole ion guide Q0. The quadrupole guide Q0 is operated in the RF voltage only mode so that it operates as an ion guide and transmits ions of a broad range of mass-to-charge (m/z) ratios. Ions then pass through Q0 into the first quadrupole rod set Q1. As discussed above, quadrupole Q1 is supplied with suitable RF and DC voltages to operate as a mass filter, to select ions with a desired mass-to-charge (m/z) ratio.

A mass selected precursor ion from the first rod set Q1 is then injected into the collision cell 28 surrounding Q2, to produce fragment ions as is known, by collision with a gas (e.g. Argon) in the collision cell 28. The fragment ions can then be analyzed to obtain a fragment ion spectrum. If the energy with which the precursor ions enter the collision cell is low, they remain largely undissociated. The extent of ion fragmentation can be controlled by changing the injection energy and by changing the type and the pressure of the gas in collision cell 28. A blocking potential is applied to the exit plate 27 so that these fragment ions are not immediately transmitted to the downstream quadrupole rod set Q3. A blocking potential is then applied to the inlet 24 of the collision cell 28, to prevent additional ions entering the collision cell 28.

Under these conditions, the collision cell 28 forms a radio frequency linear ion trap (LIT). As is conventionally known once ions are accumulated within the linear ion trap 28, the precursor ion or the fragment ion of a particular mass to charge ratio (m/z) can then be isolated in the collision cell 28 by a number of methods, such as resonance ejection of all other ions, application of RF and DC voltages to the collision cell 28 to isolate an ion at the tip of a stability region, or ejection of ions with an mass-to-charge (m/z) ratio lower than that of the selected ion by increasing the RF voltage or other known means. Accordingly, the precursor ion can be accelerated axially into collision cell 28 with sufficient axial energy to access the fragmentation pathway of interest. During the fill period, if the potential on exit lens 27 is held sufficiently high, fragment ions accumulate within collision cell 28. That is, ions are reflected by a positive potential at the exit lens 27 of collision cell 28 end. At the same time, it remains improbable that ions, reflected from the exit lens 27, would retain sufficient axial energy after collisional damping to overcome the potential barrier at entrance lens 25 of collision cell 28.

Now, in accordance with the present invention, instead of waiting until fragment ions have accumulated within the collision cell 28, a notched broadband waveform (NBW) is applied to the fragment ions within the collision cell 28 from a broadband waveform source 30 during the course of the Q2 fill period. It has been observed that by utilizing this procedure, a narrow mass range of fragment ions can be selectively accumulated and that accumulation can be accomplished with improved sensitivity in spite of the fringing field effects as will be described. It should be understood that any of the quadrupoles may be utilized as a linear ion trap for the purposes of practicing the present invention. The resulting fragment ions may be subjected to additional stages of collision activated dissociation (CAD) and ion-isolation by conventionally known techniques. A mass spectrum of the selected fragment ions may be obtained by transferring ions to the final quadrupole rod set Q3 for mass-selective detection. That is, the quadrupole rod set Q3 provided with usual connection for supply of RF and DC voltages or RF with auxiliary RF fields.

Accordingly, the present invention describes a technique for the mass-selective accumulation of fragment ions in Q2, which were created from collision-induced dissociation of a parent ion, selected in Q1. The goal of mass-selective accumulation, and/or isolation, of a particular m/z fragment is to perform an additional stage of mass spectrometry, through collision-induced dissociation of the fragment ion and subsequent mass analysis of the second-generation fragment-ion spectrum. This process is often referred to as $MS^3$ in recognition that three stages of mass analysis have been performed. Similarly, n stages of mass analysis can be referred to as $MS^n$.

It should be understood that $MS^3$ can be performed in the spectrometer described herein. Specifically, the entire spectrum of first-generation fragments, which were created through collision-induced dissociation of the parent ion in Q2, can be transferred to the low-pressure Q3 environment, where an additional stage of ion-isolation and subsequent fragmentation is performed. With the first-generation fragments trapped in Q3, a fragment ion of interest can be isolated by adjusting the RF and DC potentials such that only a narrow range of m/z ratios, which includes the ion of interest, have stable trajectories near the apex of the first stability region. In consequence of their unstable trajectories, all other ions are neutralized on the rods. Subsequently, the isolated fragment ion can be moved to more favourable stability coordinates and dissociated through resonant excitation by an auxiliary dipolar signal. The second-generation fragment ion spectrum can be detected through mass-selective axial ejection from Q3 (as described in U.S. Pat. No. 6,117,668 by Hager).

It is noteworthy that the present invention provides an attractive alternative to the RF/DC method of ion isolation described above. The same technique, which has been used to accumulate ions mass-selectively in Q2, could be applied equally well during the fill period of Q3.. Furthermore, both the RF/DC and NBW techniques of ion isolation are more effective in the lower-pressure environment of Q3.. That is, a much greater proportion of the ion of interest is retained while unwanted ions, particularly those within a few Daltons of the ion of interest, are removed completely.

Figure 1B:
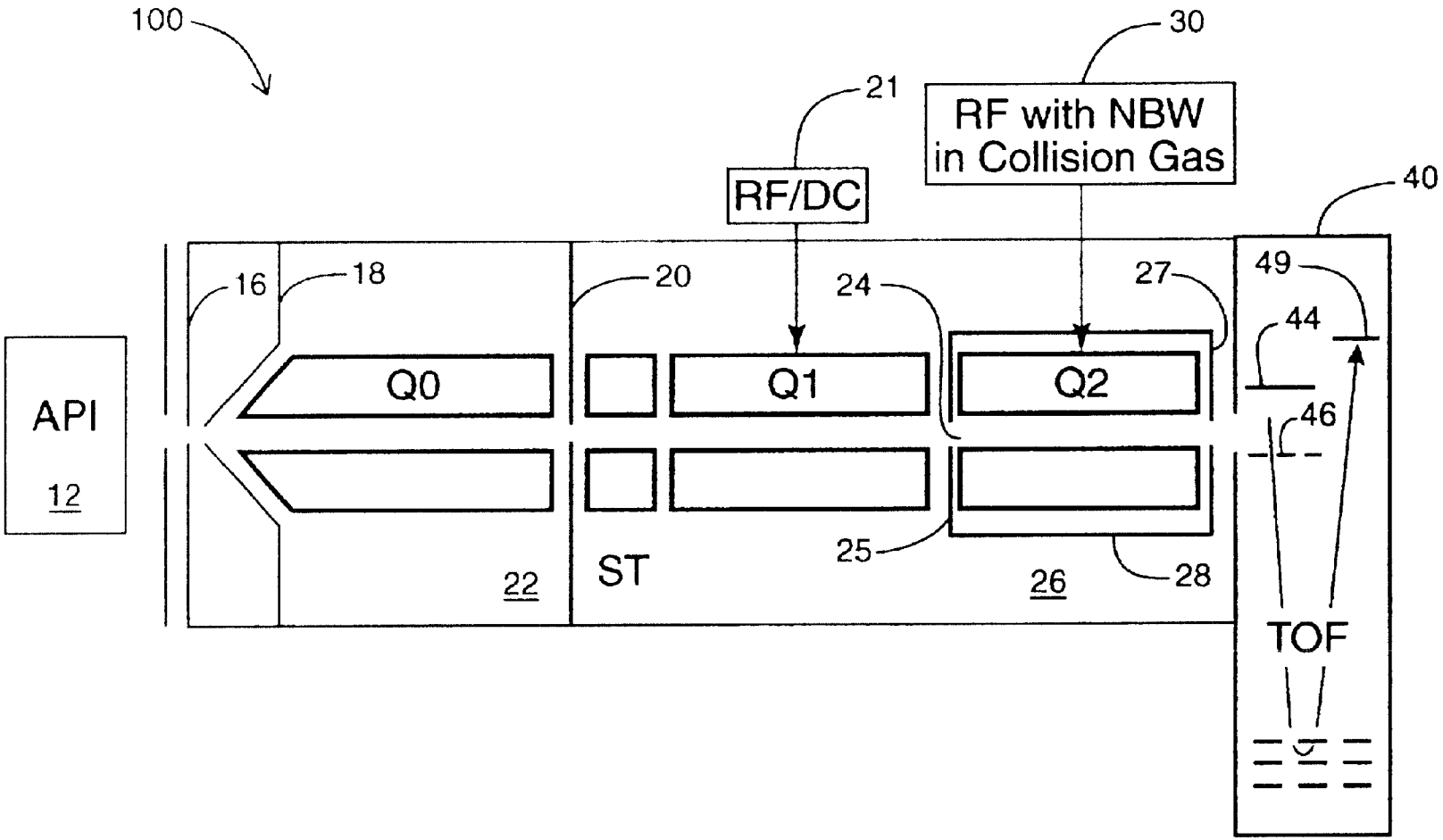

FIG. 1B shows the general structure of a conventional quadrupole orthogonal time of flight mass spectrometer (QqTOF) mass spectrometer 100 configured to implement the invention, where in known manner, the third quadrupole rod set Q3 and detector 36 of the mass spectrometer 10 of FIG. 1A configuration is replaced by a time of flight (TOF) section indicated at 40. The procedures described in respect of the triple-stage mass spectrometer 10 (FIG. 1A) apply equally well to this configuration and for simplicity, like elements in FIG. 1B are given the same reference numerals as in FIG. 1A, and description of these components is not repeated.

In FIG. 1B, the time of flight device 40 is connected to the exit plate 27 of the collision cell 28. In known manner, the time of flight device 40 includes a connection to a pump (not shown) for maintaining a vacuum at $5\times10^{-7}$ torr. It includes a repeller grid 44 and other grids indicated schematically at 46, for collecting ions entering the time of flight device 40 and transmitting a pulse of ions. The time of flight device 40 shown in FIG. 1B is a reflectron and includes grids 48 for reflecting the ion beam, which is then detected by a detector 49. The apparatus shown in FIG. 1B would be operated in an essentially similar manner to that shown in FIG. 1A. The principle difference is that the time of flight device 40 can record $10^4$ or more complete mass spectra in one second. Thus for applications where a complete mass spectrum of fragment ions is desired the duty cycle is greatly improved with a time of flight mass analyzer 40 and spectra can be acquired more quickly.

Again, in accordance with the present invention, instead of waiting until fragment ions have accumulated within the collision cell 28, a notched broadband waveform (NBW) is applied to the fragment ions within the collision cell 28 from a broadband waveform source 30 during the course of the Q2 fill period. It has been observed that by utilizing this procedure, a narrow mass range of fragment ions can be selectively accumulated and that accumulation can be accomplished with improved sensitivity in spite of the fringing field effects. As discussed before, the resulting fragment ions may be subjected to additional stages of collision activated dissociation (CAD) and ion-isolation by conventionally known techniques. A mass spectrum of the selected fragment ions may be obtained by transferring ions to the orthogonal time-of-flight component to effect mass-selective detection.

The inventors have observed that ions injected with appreciable axial kinetic energy (such as those used in a collision activated disassociation (CAD) event) into a linear ion trap, spend a relatively short time in the entrance fringing-field and accordingly, ion losses due to fringing-field effects are minimized. Furthermore, ions are initially focused into a linear ion trap by an entrance electrostatic lens near the centreline, and then focused further, once in the trap, by collisional damping at pressures of 2–10 mTorr. Accordingly, it has been observed that such focused ions are less susceptible to fringing-field distortions.

The present inventors have determined that selective accumulation of a narrow range of fragment ions can in fact be achieved by application of a notched broadband waveform to a quadrupole operated as a linear ion trap during the accumulation of ions. Fragment ions are formed via the axial acceleration and collision activated dissociation (CAD) of mass resolved precursor ions into an RF-only, or substantially RF-only, quadrupole collision cell operated as a linear ion trap. Broadband waveforms are generally utilized to excite resonantly and destroy unwanted fragment ions and un-dissociated precursor ions stored in the multipole. A narrow band of frequencies is omitted purposefully from the spectrum, and the RF and DC levels are chosen to establish stability coordinates for the m/z ratio of interest, such that the secular frequency of a particular fragment ion will fall within this notch of absent frequencies. These ions do not experience resonant excitation and are retained in the trapping device while all others are lost either through neutralization when they strike electrodes or through (additional) collision activated dissociation (CAD). When such a notched broadband waveform is applied to a multipole operated as a storage device during a collision activated event involving the axial acceleration of a mass resolved precursor ion, unwanted ions are lost as quickly as, or soon after, they are formed. In this manner, a particular mass or range of masses, whose secular frequencies fall within the notch of absent frequencies in the notched broadband waveform, may be accumulated selectively during the collision activated dissociation event.

The present inventors have demonstrated the effectiveness of a notched broadband waveform, applied during the Q2 fill period, to isolate a narrow mass range of relatively low intensity ions and accordingly to achieve coarse isolation of a small cluster of masses. Specifically, the 204–207 cluster in the fragment-ion spectrum of bromocriptine was selected for illustrative purposes.

Specifically, FIGS. 2A to 2D illustrate coarse isolation of the 204–207 cluster of the fragment ion spectrum of bromocriptine, without (FIGS. 2A and 2B) and with (FIGS. 2C and 2D) a notched broadband waveform applied during the Q2 fill within the collision cell 28 of mass spectrometer 10 (FIG. 1A). In this instance, the RF amplitude on Q2 was adjusted such that the stability coordinates of m/z 206 were (a, q)=(0, 0.749)

Figure 2A:
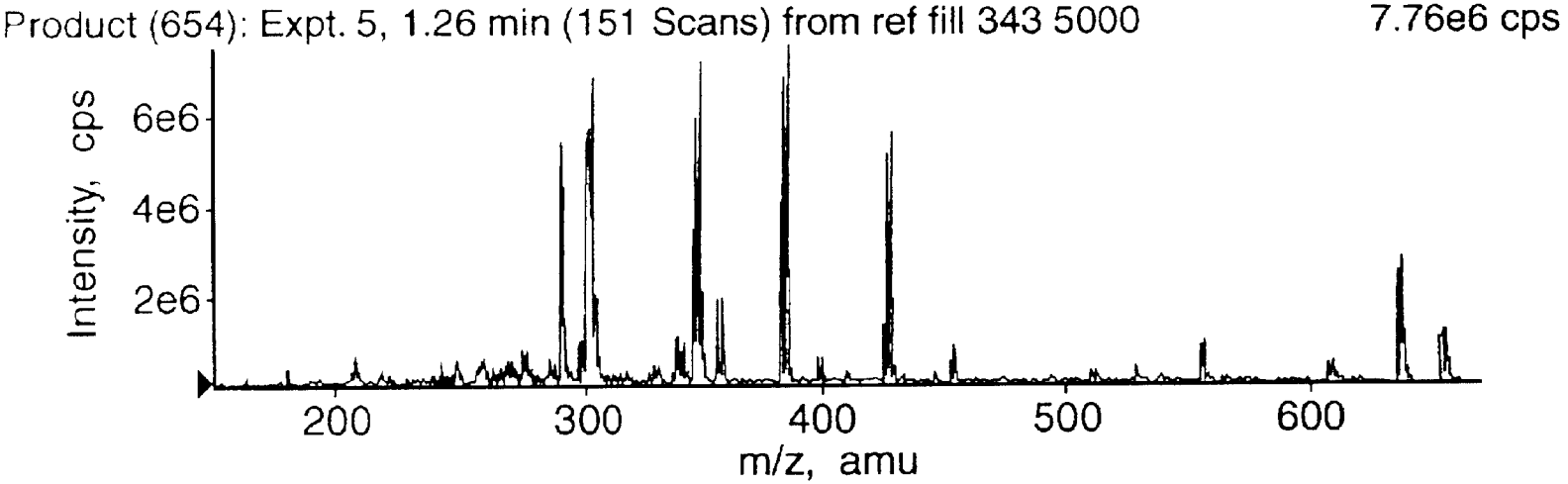
FIG. 2A shows a graph of the fragment ion spectrum of bromocriptine after fragment ions have been selected by the first quadrupole Q1 and accumulated within the linear ion trap of the mass spectrometer shown in FIG. 1A.
Figure 2B:
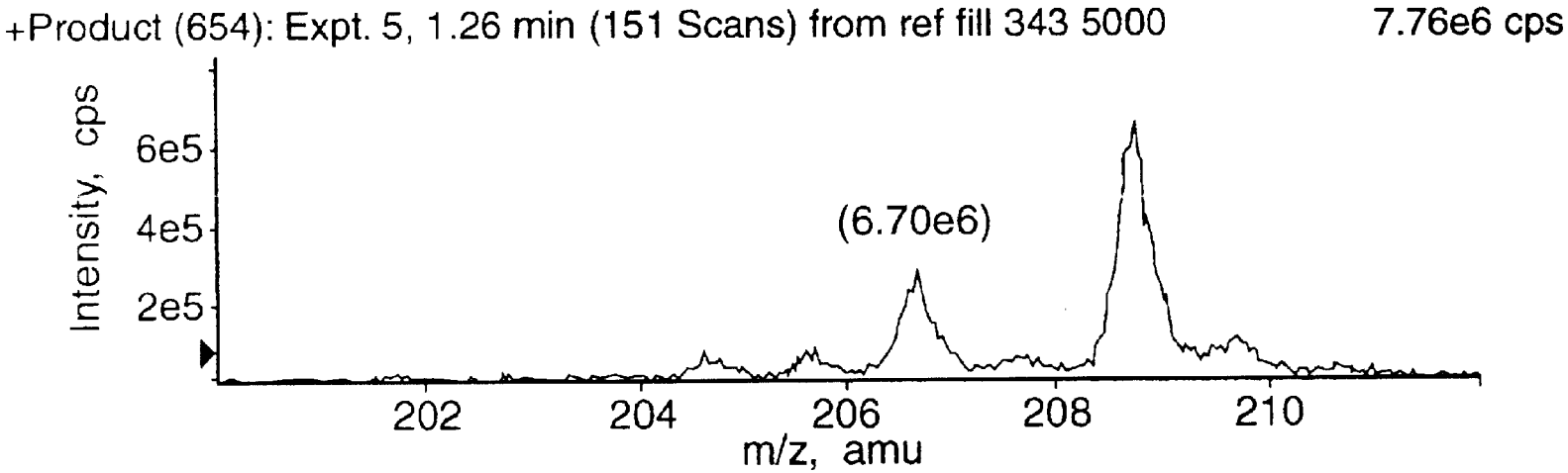
FIG. 2B is an expanded view of the 204–207 fragment ion cluster of the graph of FIG. 2A.

FIGS. 2A and 2B show the fragment ion spectrum for various mass-to-charge (m/z) values in counts per second (cps) that is obtained when the parent ion cluster of bromocriptine, masses 654–657, was selected by the first quadrupole Q1 and injected into the collision cell 24 at 40 eV. The counts-per-second (cps) measure corresponds to the intensity recorded at each individual RF increment. FIG. 2B illustrates an expanded view of the 204–207 ion cluster as shown in the graph of FIG. 2A. It should be understood that no broadband waveforms of any kind are applied to the collision cell 28 in this case. It should be noted that the bracketed valve in FIG. 2B is an integral over the mass range 204–207, that is, the sum of the intensities recorded at each individual RF increment.

Figure 2C:
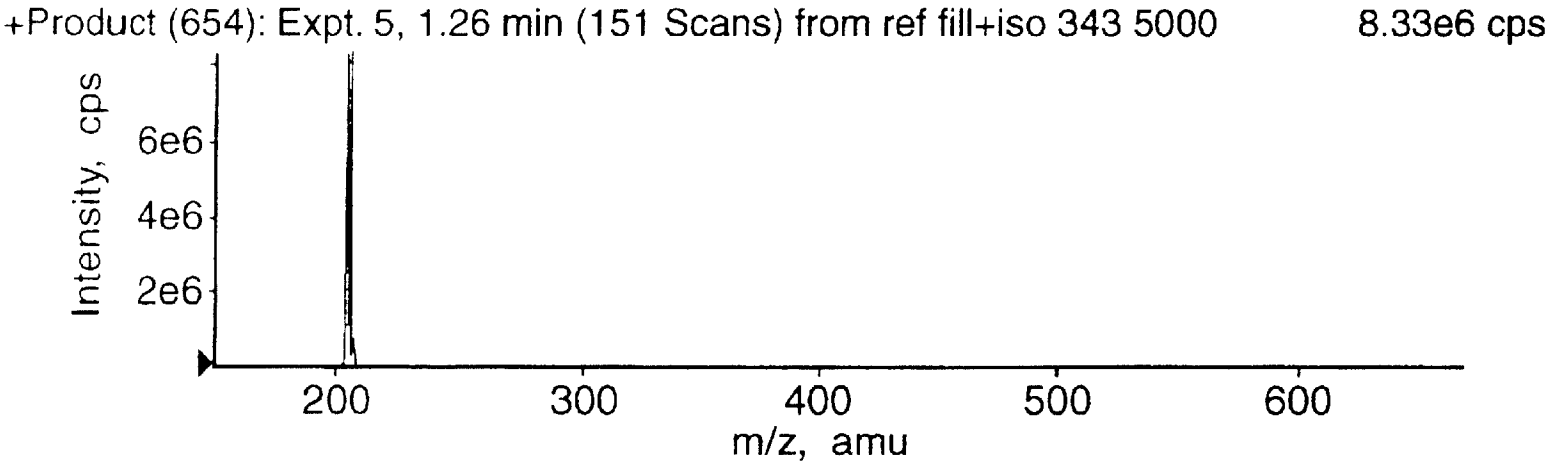
FIG. 2C shows a graph of the fragment ion spectrum of bromocriptine where a notched broadband waveform is applied during the accumulation of fragment ions within the linear ion trap.
Figure 2D:
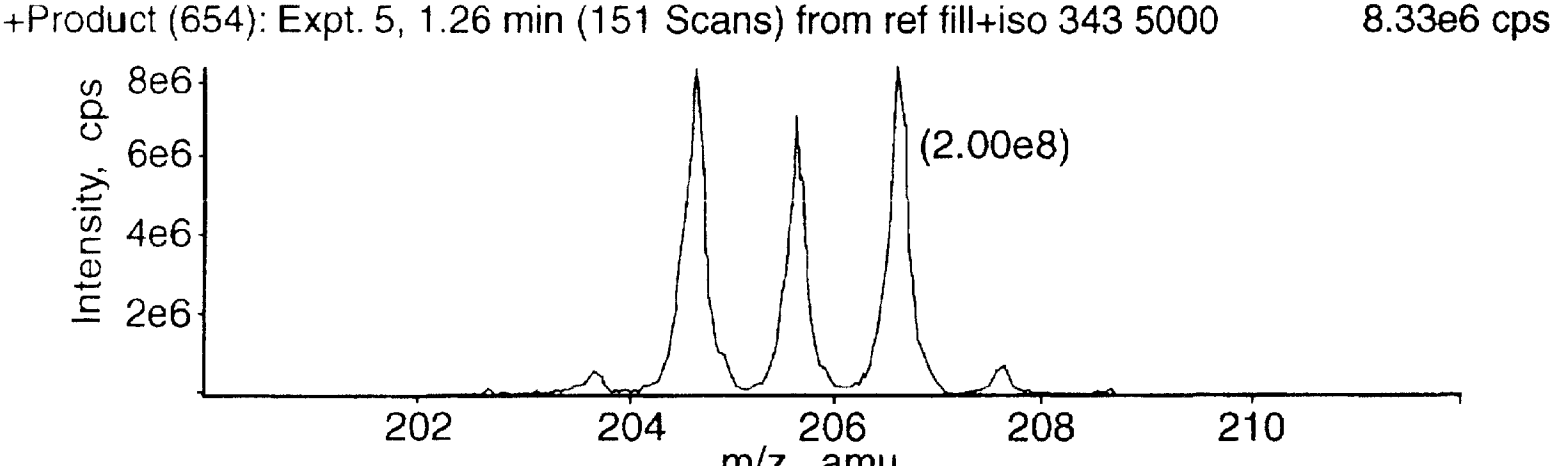
FIG. 2D is an expanded view of the 204–207 fragment ion cluster of the graph of FIG. 2C.

FIGS. 2C and 2D show the fragment ion spectrum for various mass-to-charge (m/z) ratios in counts per second (cps) that is observed when a notched broadband waveform is applied during a 5000 millisecond collision cell 24 fill period. As can be seen, course isolation of the 204–207 ion cluster is achieved. No additional waveforms were applied to the collision cell 24 after the Q2 fill. The width of the notch in the notched broadband waveform used, corresponds to $\Delta$=5.2 Da with mass 206 centered in the notch at 310 kHz. For purposes of discussion herein, the parameter $\Delta$ is defined as the separation, in the mass domain, of the resonant frequency of the ion of interest from the frequency components that define the inner-bounds of the notch of absent frequencies in a composite waveform. It should again be noted that the bracketed valve in FIG. 2D is an integral over the mass range 204–207, that is, the sum of the intensities recorded at each individual RF increment.

Accordingly, the application of a notched broadband waveform during the Q2 fill results in a fragment ion spectrum for the selected ion cluster that has a significantly higher intensity than that obtained without the application of a notched broadband waveform (FIGS. 2A and 2B). The reason for this is that since ions that are not of interest are removed by the application of the notched broadband waveform during Q2 fill (i.e. as soon as possible after formation) so that ions of interest can be accumulated without space charge encumbrances. Specifically, as shown in the spectrum results of FIG. 3D, it is probable that the ions indicated are third, or even fourth, generation ions. This substantially high intensity values of the various ions illustrate the signal enhancement that results due to additional fragmentation induced by the isolating waveform.

FIGS. 3A to 3F illustrate unit-mass isolation of the 347 ion from the 346–349 cluster of the fragment-ion spectrum of bromocriptine with unit-mass resolution without (FIGS. 3A and 3B) and with (FIGS. 3C to 3F) the use of notched broadband waveforms applied during the collision cell 28 fill. The notched waveforms utilized in FIGS. 3C to 3F include notches centred on 310 kHz corresponding to q=0.749 In a 1 MHz system. Specifically, unit-mass isolation in the collision cell 28 of the 347 ion from the 346–349 cluster of the fragment ion spectrum of bromocriptine is illustrated. In this instance, the RF amplitude on Q2 was adjusted such that the stability coordinates of m/z 206 were (a, q)=(0, 0.749).

Figure 3A:
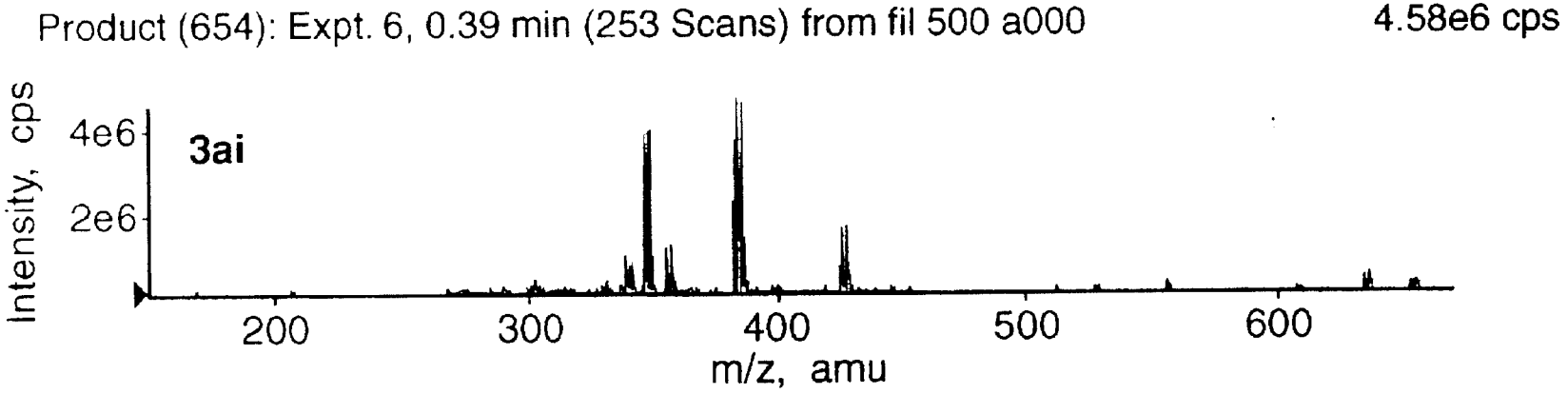
FIG. 3A shows a graph of the fragment ion spectrum of bromocriptine after fragment ions have been selected by the first quadrupole Q1 and accumulated within the linear ion trap of the mass spectrometer shown in FIG. 1A.
Figure 3B:
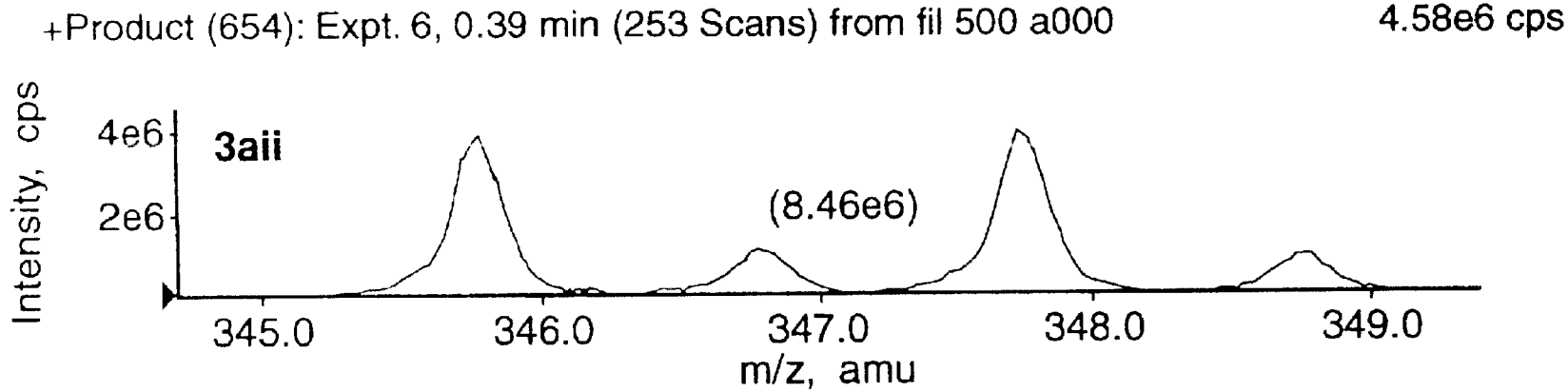
FIG. 3B is an expanded view of the 346–349 fragment ion cluster of the graph of FIG. 3A.

FIG. 3A shows the fragment ion spectrum, which is obtained when the parent ion cluster of bromocriptine, masses 654–657, is selected in first quadrupole Q1 and injected into the collision cell 24 at 40 eV FIG. 3B shows an expanded view of the 346–349 ion cluster of the graph in FIG. 3A and the integrated intensity in counts per second (cps) of the 347 ion. It should be understood that no broadband waveforms of any kind are applied to the collision cell 28 in this instance.

Figure 3C:
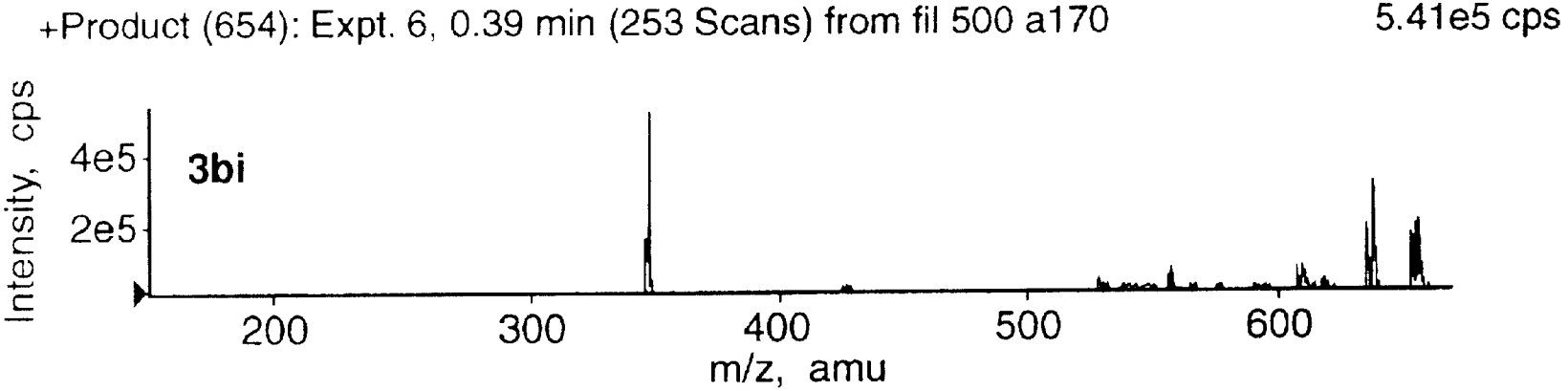
FIG. 3C shows a graph of the fragment ion spectrum of bromocriptine where a notched broadband waveform has been applied once the accumulation of the fragment ions within the linear ion trap is complete.

FIG. 3C shows the fragment ion spectrum, which is obtained when a notched broadband waveform, Δ=1.5 Da (and centered at 310 kHz), was used to isolate mass 347, in a single step, after the fill period. The amplitude of the waveform was chosen to remove most of the ions having masses within a relatively narrow range (i.e. m±1) and as a consequence, the integrated intensity of ion 347 was reduced by half, as shown in more detail in the expanded view of the graph in FIG. 3D. It should be noted that many higher mass ions, including the parent ion cluster, remain in the spectrum as shown in the graph of FIG. 3C. If the amplitude of the broadband waveform had been increased sufficiently to remove the higher mass ions, ion 347 would have been removed as well.

Figure 3D:
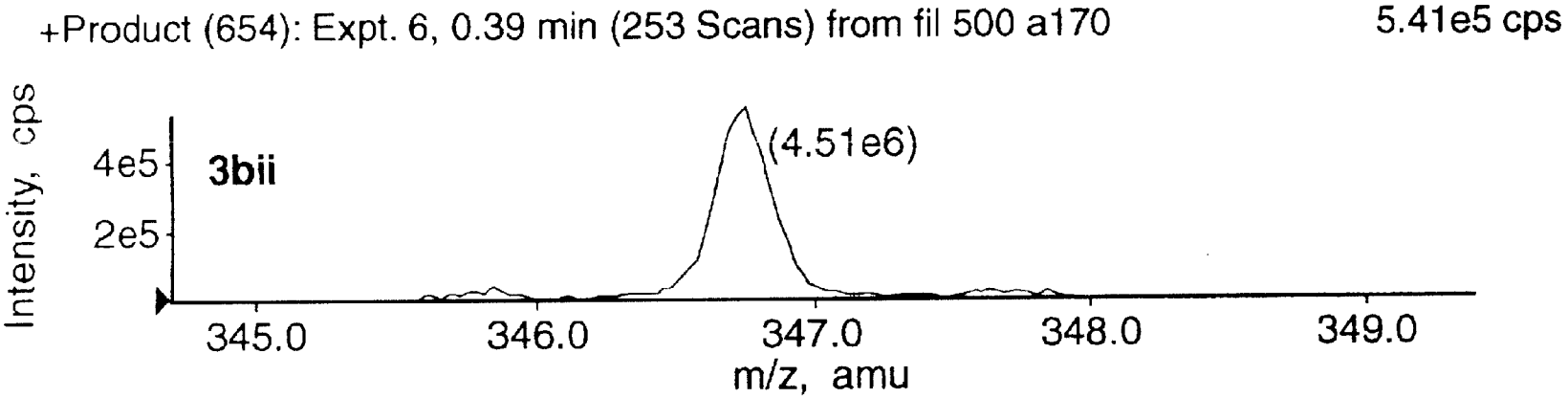
FIG. 3D is an expanded view of the 346–349 fragment ion cluster of the graph of FIG. 3C.
Figure 3E:
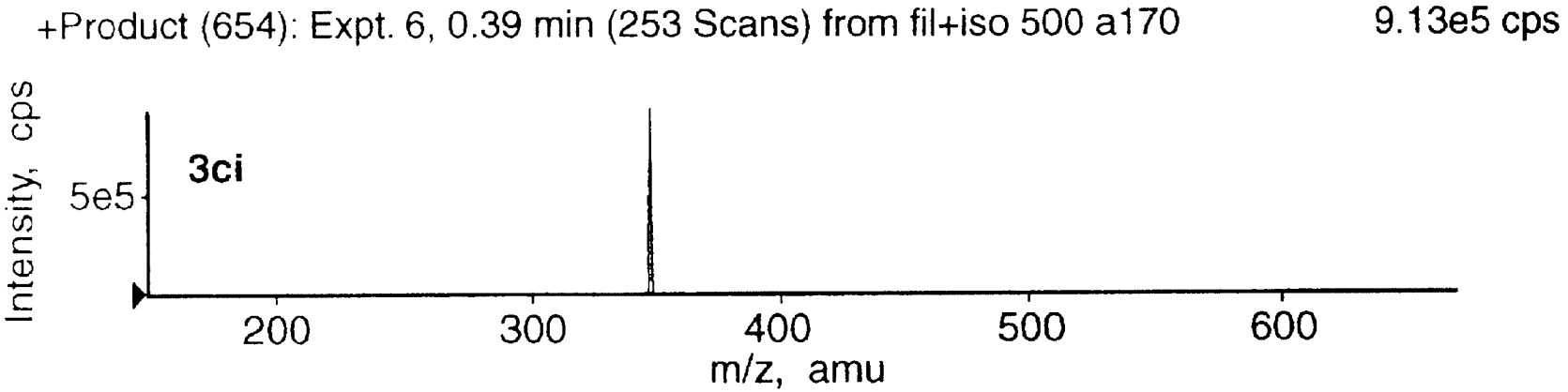
FIG. 3E shows a graph of the fragment ion spectrum of bromocriptine where a first notched broadband waveform having a first notch width has been applied to the fragment ions during their accumulation within the linear ion trap followed by application of a second notched broadband waveform, having a second notch width narrower than the first notch width, after the linear ion trap fill has been completed to effect unit-mass isolation.
Figure 3F:
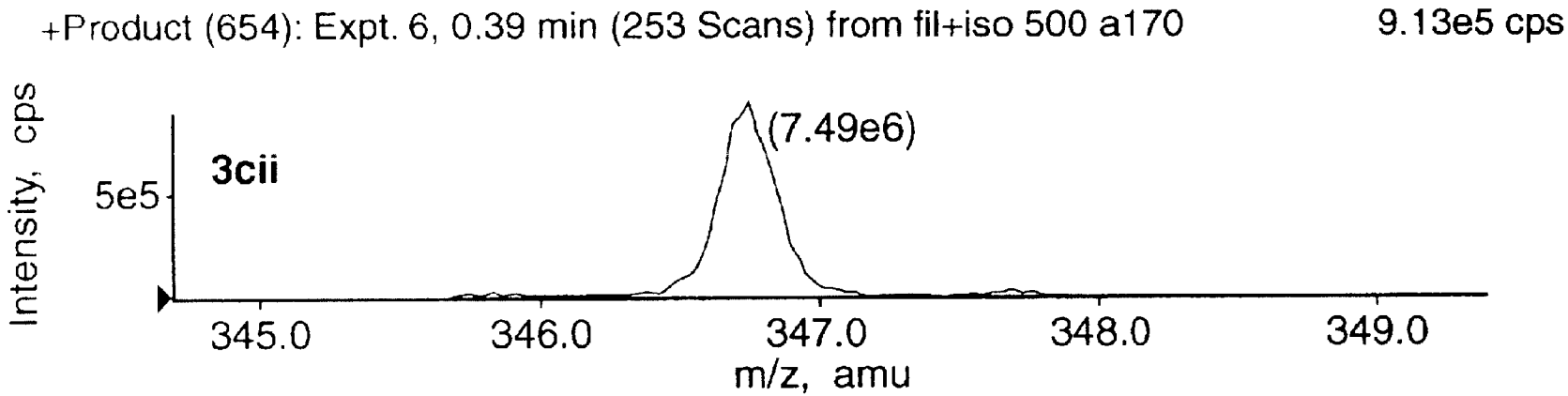
FIG. 3F is an expanded view of the 346–349 fragment ion cluster of the graph of FIG. 3E.

FIGS. 3E and 3F show the fragment ion spectrum that was obtained by applying a first notched broadband waveform with a relatively broad notch having a value of Δ=8.8 Da (i.e. compare with the previous Δ of 1.5 Da), centred on 310 kHz, during the collision cell 28 fill followed by the application of a second notched broadband waveform with a narrower notch as will be described. The amplitude of the broadband waveform was set sufficiently high to remove the higher mass ions (i.e. the parent ion cluster) effectively, yet the notch was sufficiently broad that the 346–349 ion cluster remained largely unaffected. Subsequent to the collision cell 24 fill, unit mass isolation was achieved by applying, under identical conditions, the notched broadband waveform used to obtain the spectrum of FIGS. 3C and 3D. This isolation procedure resulted in a post isolation intensity of ion 347 that was diminished little from its intensity in the unperturbed spectrum, FIGS. 3A and 3B.

Accordingly, as shown in FIGS. 3E and 3F, the application of a first notched broadband waveform having a broad notch during the Q2 fill ensures that ions of interest are not rejected during ion accumulation. The subsequent application of a second notched broadband waveform, having a notch that is narrower than the broad notch associated with the first notched broadband waveform after the Q2 fill has been completed, ensures that undesirable ions (i.e. including the parent ion cluster) are not maintained within the collision cell 28. This two-step process also results in an intensity of the selected ion that is appreciably higher than that which would result from the use of prior art methods of applying notched broadband waveforms.

Also, it should be understood that the results shown graphically in FIGS. 3E and 3F illustrate that the application of a first notched broadband waveform having a wide notch during Q2 fill allows for the development of fragment ions which can ultimately be dissociated into fragment ions of interest and selected during application of the second broadband waveform with a selectively narrow notch. This is demonstrated by the fact that the final intensity of the ion of interest is closer to the intensity in the unperturbed spectrum (FIGS. 3A and 3B) than that resulting from the prior art application of a notched broadband waveform after Q2 fill is completed (FIGS. 3C and 3D).

Accordingly, the present invention provides a method and apparatus for the selective accumulation of a narrow range of fragment ions by application of a notched broadband waveform to a quadrupole operated as a linear ion trap. When a notched broadband waveform is applied to a multipole operated as a storage device during a collision activated event involving the axial acceleration of a mass resolved precursor ion, unwanted ions are lost as quickly as, or soon after, they are formed. In this manner, a particular mass or range of masses, whose secular frequencies fall within the notch of absent frequencies in the notched broadband waveform and at relatively high intensities, may be accumulated selectively during the collision activated dissociative event. It is further recognized that the population of the fragment ion may be increased via adjustment of the notched broadband waveform amplitude during the injection period to promote the collision activated,dissociation of other fragment ions whose fragmentation pathway involves the formation of the fragment ion of interest. In this manner, the fragment ion of interest may be accumulated selectively and with improved sensitivity.

The observed favourable injection characteristics of the linear ion trap allows a notched broadband waveform to be applied to a collision cell that is operated as a linear ion trap (LIT) such that unwanted fragment ions formed during an axial acceleration collision activated dissociation event are radially ejected as quickly as, or soon after, they are formed. Also, it has been determined that the application of a notched broadband waveform during an axial acceleration collision activated dissociation event while ramping the amplitude of the waveform during the accumulation process to promote the consecutive decomposition of unwanted fragment ions to the fragment ion of interest. In this manner, the abundance of the fragment ion of interest may be increased.

The application of a notched broadband waveform during the collision activated dissociation event can also serve as an initial step in the isolation of the fragment ion for the purpose of tandem mass spectrometry (i.e. $MS^n$) or the processes which analyze beyond the initial fragment ions ($MS^2$) to second ($MS^3$) and third generation fragment ions ($MS^4$). Furthermore, it is also recognized that selective accumulation of fragment ions in the collision cell of a triple-stage quadrupole mass spectrometer offers a duty cycle advantage when the quadrupole rod set Q3 is operated as a LIT, from which ions may be scanned mass-selectively (as described by Hager in U.S. Pat. No. 6,117,668).

As will be apparent to those skilled in the art, various modifications and adaptations of the structure described above are possible without departing from the present invention, the scope of which is defined in the appended claims.

What is claimed is:

1. A method of analyzing a substance in a mass spectrometer apparatus comprising an ion source, a quadrupole ion guide, and a linear ion trap, the method comprising the steps of:

(a) ionizing the substance to generate a stream of ions;

(b) supplying the stream of ions to the quadrupole ion guide to select ions within a broad range of mass-to-charge ratios;

(c) providing the stream of ions from the quadrupole ion guide to the linear ion trap for the generation and accumulation of fragment ions;

(d) as the stream of ions are being provided to the linear ion trap, applying a first notched broadband waveform having a first notch width to the linear ion trap such that only fragment ions within a predetermined mass range and having a resonance frequency falling within the frequency band of the notch are selectively accumulated in the linear on trap; and (e) analyzing the fragment ion spectrum after accumulation.

2. A method as claimed in claim 1, wherein step (c) comprises the step of applying radio frequency potential and a collision gas to the fragmented ions within the linear ion trap.

3. A method as claimed in claim 1, wherein step (d) further comprises the step of adjusting the amplitude of the notched broadband waveform so as to promote the collision activated dissociation of ions whose fragmentation pathway involves the formation of fragment ions within the predetermined mass range.

4. A method as claimed in claim 3, wherein the step of adjusting the amplitude of the notched broadband waveform consists of ramping the amplitude of the notched broadband waveform through a predetermined range of values.

5. A method as claimed in claim 1, wherein step (d) is the initial step in the isolation of the fragment ion for the purposes of tandem mass spectrometry.

6. A method as claimed in claim 1, wherein step (d) is followed by the application of a second notched broadband waveform after the accumulation of the fragment ions within the linear ion trap is complete, said second notched broadband waveform having a second notch width that is less than the first notch width of the first notched broadband waveform.

7. A method as claimed in claim 1, wherein the fragment ion spectrum is analyzed after accumulation using a quadrupole mass detector.

8. A method as claimed in claim 1, wherein the fragment ion spectrum is analyzed after accumulation using a time-of-flight mass analyzer.

9. An apparatus for analyzing a substance, the apparatus comprising:

(a) an ion source for generating a stream of ions;

(b) a quadrupole ion guide for receiving the stream of ions and for selecting ions within a broad range of mass-to-charge ratios;

(c) a linear ion trap to receive the selected ions from the quadrupole ion guide and to generate and accumulate fragment ions from the stream of ions;

(d) means coupled to said quadrupole ion guide for generating and applying a notched broadband waveform to the linear ion trap during the accumulation of fragment ions such that only fragment ions within a predetermined mass range and having a resonance frequency falling within the frequency band of the notch are selectively accumulated in the linear ion trap; and (e) a mass analyzer connected to the quadrupole ion guide, for receiving fragment ions from the linear ion guide and for analyzing the ion spectrum.

10. An apparatus as claimed in claim 9, wherein the means for generating and applying a notched broadband waveform provides a first notched broadband waveform with a first notch width and a second notched broadband waveform with a second notch width, said second notch width being less than said first notch width.

11. An apparatus as claimed in claim 9, wher in the linear ion trap is a collision cell having a entrance plate and an exit plate, each of which is applied a blocking potential.

12. An apparatus as claimed in claim 9, wherein the mass analyzer comprises a quadrupole mass detector.

13. An apparatus as claimed in claim 9, wherein the mass analyzer comprises a time-of-flight mass analyzer.

14. An apparatus as claimed in claim 9, further comprising means for providing radio frequency radiation and a collision gas to the fragmented ions within the second quadrupole ion guide.

* * * * *